US008364069B2

(12) United States Patent
Arai et al.

(10) Patent No.: US 8,364,069 B2
(45) Date of Patent: Jan. 29, 2013

(54) CLEANING DEVICE, IMAGE FORMING APPARATUS, AND LUBRICANT

(75) Inventors: Kazuhiko Arai, Kanagawa (JP); Shinichi Kawamata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 12/845,278

(22) Filed: Jul. 28, 2010

(65) Prior Publication Data

US 2011/0206430 A1 Aug. 25, 2011

(30) Foreign Application Priority Data

Feb. 19, 2010 (JP) ..... 2010-034505

(51) Int. Cl.
*G03G 21/00* (2006.01)

(52) U.S. Cl. ..... 399/346

(58) Field of Classification Search ..... 399/343, 399/346, 350–353
See application file for complete search history.

(56) References Cited

U.S. PATENT DOCUMENTS

2010/0021205 A1* 1/2010 Honjoh et al. ..... 399/123

FOREIGN PATENT DOCUMENTS

| | | |
|---|---|---|
| JP | A 8-171315 | 7/1996 |
| JP | A 2003-295707 | 10/2003 |
| JP | A 2004-279734 | 10/2004 |

* cited by examiner

*Primary Examiner* — Hoang Ngo
(74) *Attorney, Agent, or Firm* — Oliff & Berridge, PLC

(57) ABSTRACT

A cleaning device includes a scraping member that scrapes foreign materials from a member to be cleaned while being in contact with the member to be cleaned, and a lubricant supply unit that supplies a lubricant upstream of a contact position between the member to be cleaned and the scraping member in a moving direction of the member to be cleaned. The lubricant supply unit supplies a powder of a solid lubricant containing a fatty acid metal salt and a fluorocarbon resin.

16 Claims, 6 Drawing Sheets

FIG. 5

| RATIO OF PTFE TO ZINC STEARATE | RESULT |
|---|---|
| 0% | ×× |
| 1% | × |
| 2% | △ |
| 3% | ○ |
| 5% | ○ |
| 10% | ○ |
| 20% | ○ |
| 30% | △ |
| 35% | ××× |

CLEANING DEVICE, IMAGE FORMING APPARATUS, AND LUBRICANT

CROSS-REFERENCE TO RELATED APPLICATIONS

This application is based on and claims priority under 35 USC 119 from Japanese Patent Application No. 2010-034505 filed Feb. 19, 2010.

BACKGROUND (i) Technical Field

The present invention relates to a cleaning device, an image forming apparatus, and a lubricant.

(ii) Related Art

SUMMARY

According to an aspect of the invention, there is provided a cleaning device including a scraping member that scrapes foreign materials from a member to be cleaned while being in contact with the member to be cleaned, and a lubricant supply unit that supplies a lubricant upstream of the contact position between the member to be cleaned and the scraping member in the moving direction of the member to be cleaned. The lubricant supply unit supplies a powder of a solid lubricant containing a fatty acid metal salt and a fluorocarbon resin.

BRIEF DESCRIPTION OF THE DRAWINGS

Exemplary embodiments of the present invention will be described in detail based on the following figures, wherein:

FIGS. 4A, 4B, 4C, and 4D are schematic diagrams showing a cleaning blade provided in the cleaning device shown in FIG. 2, in which FIG. 4A shows an operation of the cleaning blade when a lubricant containing zinc stearate is supplied in an amount larger than a proper amount, FIG. 4B shows an operation of the cleaning blade when a lubricant containing zinc stearate is supplied in an amount larger than in the case shown in FIG. 4A, FIG. 4C shows an operation of the cleaning blade when a lubricant containing zinc stearate is supplied in an amount smaller than the proper amount, and FIG. 4D shows an operation of the cleaning blade when a lubricant containing zinc stearate and polytetrafluoroethylene (hereinafter referred to as "PTFE") is supplied;

FIG. 5 is a table showing a relation between the results of cleaning and the ratio of PTFE to zinc stearate in a lubricant used in the cleaning device shown in FIG. 2.

DETAILED DESCRIPTION

Exemplary embodiments of the present invention are described below with reference to the drawings.

Figure 1:
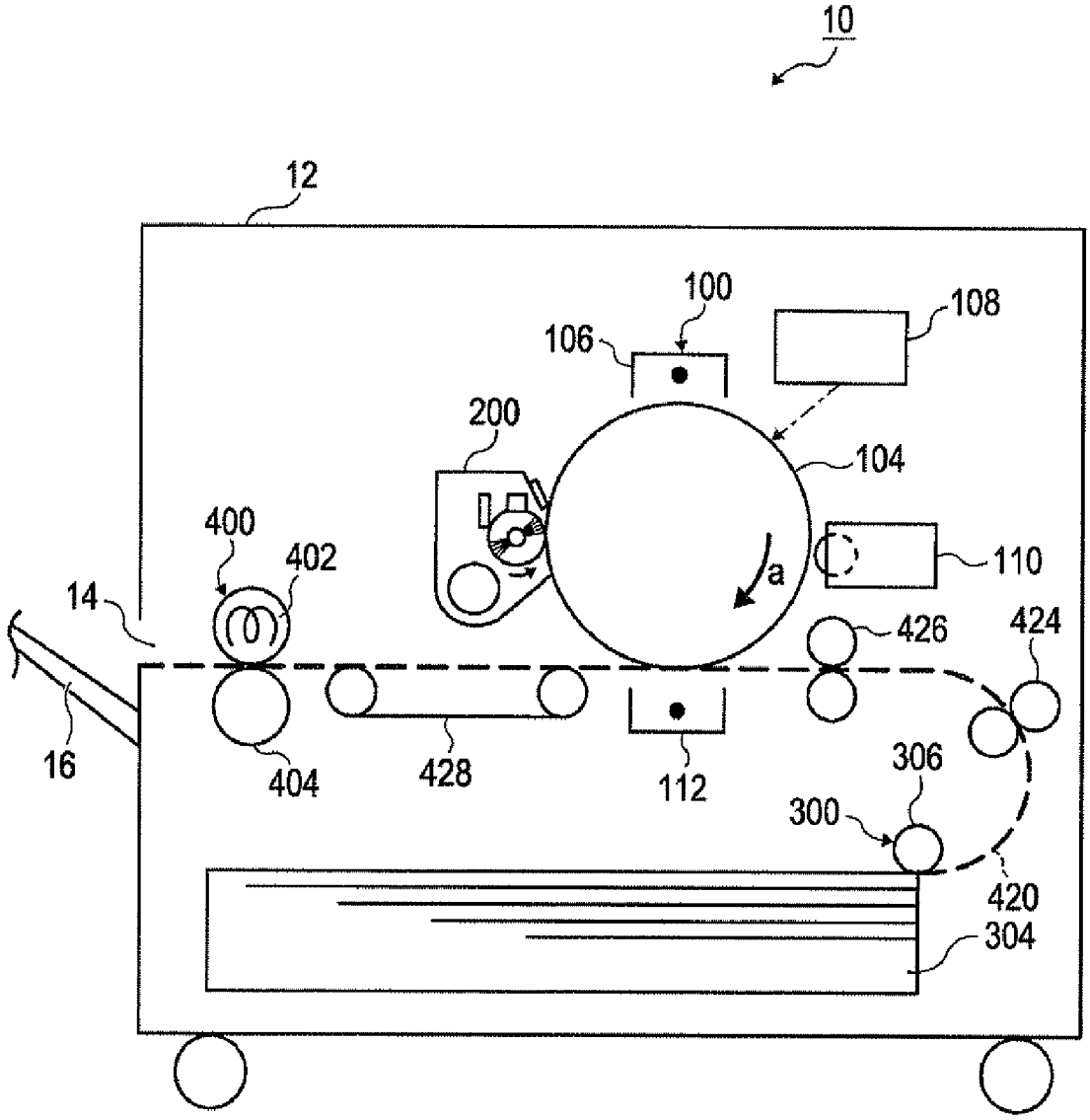
FIG. 1 is a sectional view showing an image forming apparatus according to a first exemplary embodiment of the present invention as viewed from the front side.

FIG. 1 shows an image forming apparatus 10 according to a first exemplary embodiment of the present invention. As shown in FIG. 1, the image forming apparatus 10 includes an image forming apparatus body 12 in which an image forming portion 100, a paper feeder 300, and a fixing device 400 are provided. In addition, a transport path 420 is formed in the image forming apparatus body 12.

Further, a discharge port 14 used for discharging paper is formed in the image forming apparatus body 12, and a discharge portion 16 is provided for holding the paper discharged through the discharge port 14.

The image forming portion 100 is used as a member to be cleaned and used as an image carrier. The image forming portion 100 includes a photoconductor drum 104 rotated in a direction of arrow a shown in FIG. 1, a charging device 106 that charges the photoconductor drum 104, an electrostatic latent image forming device 108 that forms an electrostatic latent image on the surface of the photoconductor drum 104 by applying a laser beam to the surface of the photoconductor drum 104 charged by the charging device 106, a developing device 110 that develops the latent image formed by the electrostatic latent image forming device 108 using a toner used as an image forming agent, a transfer device 112 that transfers, to paper used as a transfer medium, a toner image developed by the developing device 110 and held on the photoconductor drum 104, and a cleaning device 200 that cleans off the toner remaining on the photoconductor drum 104 after transfer by the transfer device 112.

The paper feeder 300 includes a paper storing portion 304 that stores, in a stacked state, paper sheets used as a transfer medium, and a delivery roll 306 that delivers the paper stored in the paper storing portion 304 to the image forming portion 100.

The transport path 420 transports paper from the paper feeder 300 to the image forming portion 100 and transports paper from the image forming portion 100 to the discharge portion 16. A transport roll 424, a register roller 426, the transfer device 112, the transport device 428, and the fixing device 400 are arranged along the transport path 420 in order from the upstream side in the paper transport direction.

The transport roll 424 transports the paper delivered from the delivery roll 306 to the register roll 426. The register roll 426 temporarily stops the movement of the leading edge of paper that is transported to the transfer device 112 and starts the movement of the leading edge of paper to the transfer device 112 with timing such that a portion of the photoconductor drum 104 on which the toner image is formed reaches the position of the transfer device 112. The transport device 428 transports paper with an unfixed toner image transferred to the upper surface thereof to the fixing device 400 in such a manner that the paper is supported from the lower side.

The fixing device 400 includes a heating roll 402 provided with a heat source and a pressure roll 404 pressed into contact with the heating roll 402 so that the toner image is fixed by applying heat and pressure.

Figure 2:
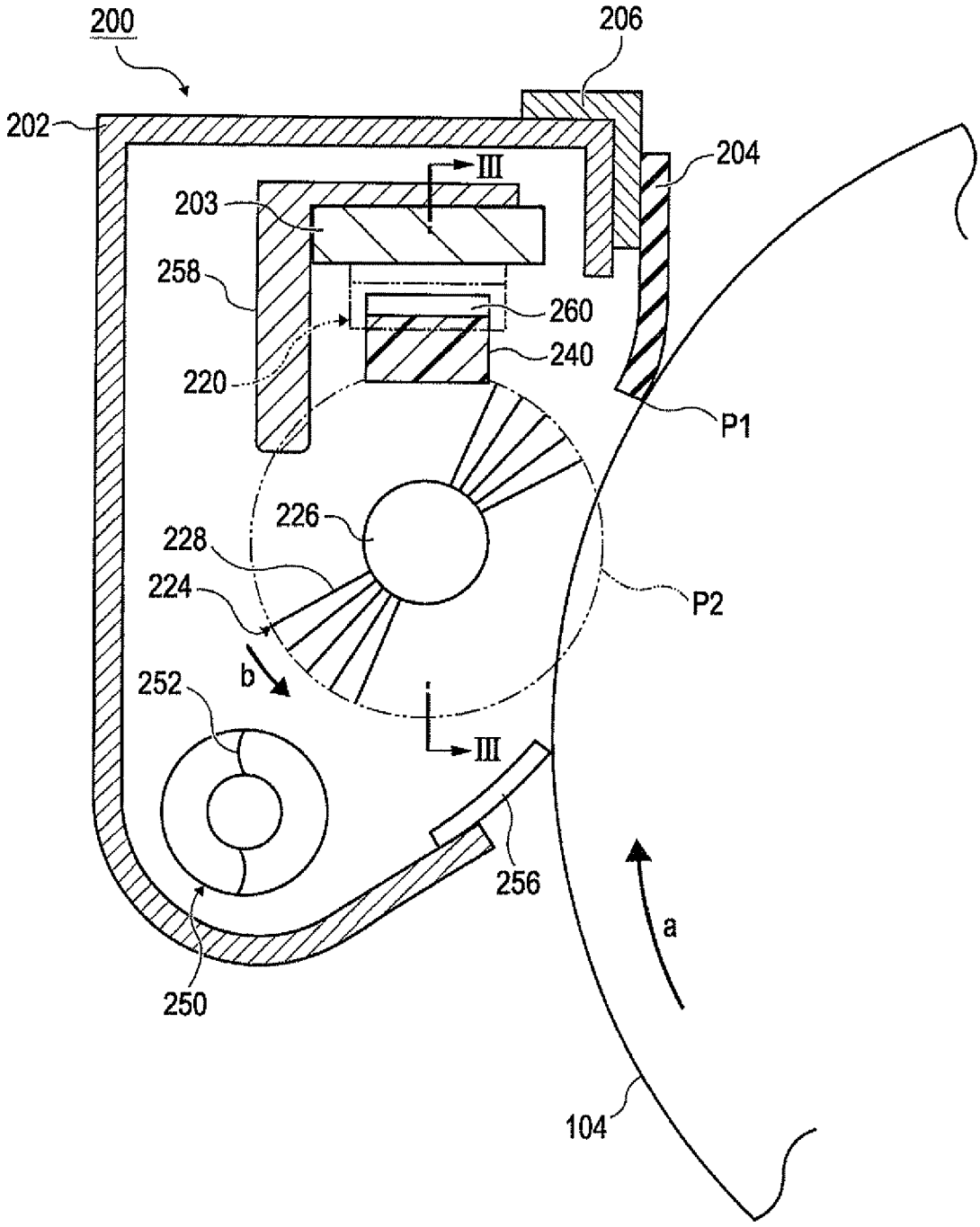
FIG. 2 is a sectional view showing a cleaning device provided in the image forming apparatus shown in FIG. 1 as viewed from the front side.
Figure 3:
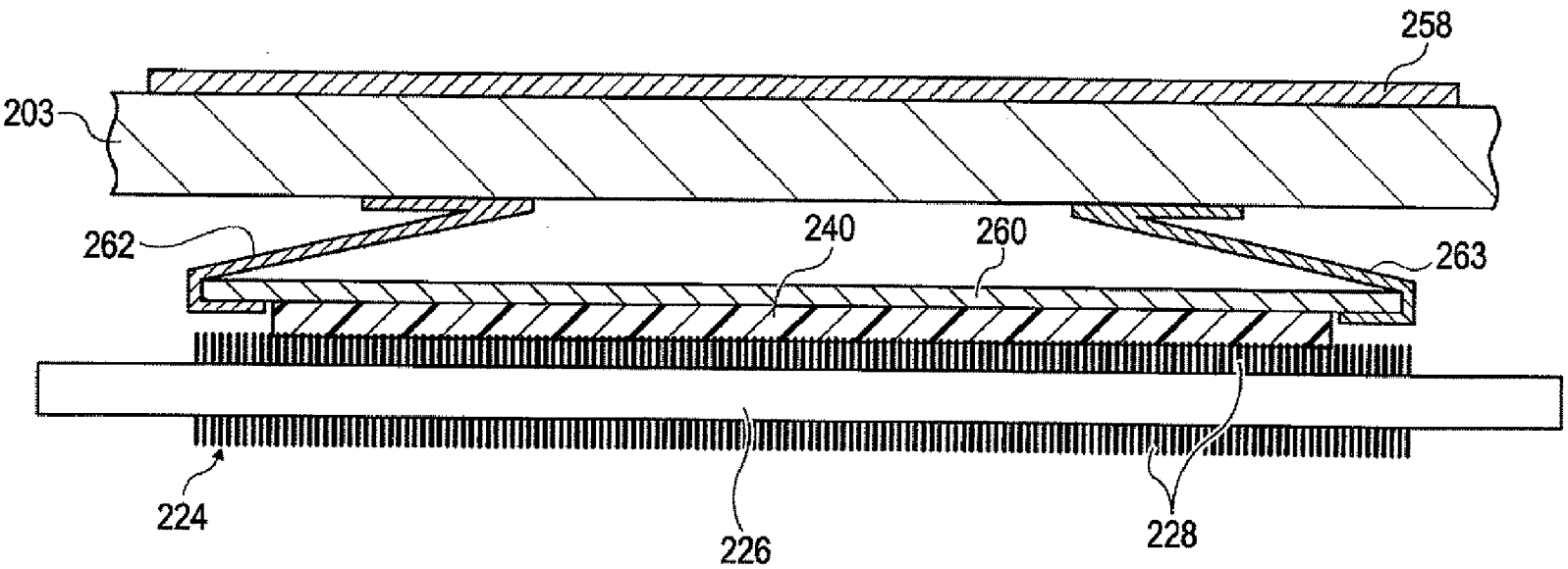
FIG. 3 is a sectional view of the cleaning device taken along line in FIG. 2.

FIGS. 2 and 3 show the cleaning device 200. The cleaning device 200 includes a cleaning device body 202 having an opening formed on the photoconductor drum side, the cleaning device body 202 being provided with a cleaning blade 204. The cleaning blade 204 is in contact with the photoconductor drum 104 and is used as a scraping member that scrapes the toner, paper dust, and the like from the photoconductor drum 104. A material of the cleaning blade 204 is, for example, synthetic rubber and has flexibility. One of the ends of the cleaning blade 204 is attached to the cleaning device body 202 through a support member 206, and the other end is in contact with the periphery of the photoconductor drum 104 at position P1. The cleaning blade 204 is attached so that a biting amount into the peripheral surface of the photoconductor drum 104 is, for example, about 0.7 to 1.3 mm.

The cleaning device 200 includes a lubricant supply unit 220. The lubricant supply unit 220 is used for supplying a lubricant at position P2 upstream of the position P1 of contact between the photoconductor drum 104 and the cleaning blade 204 in the moving direction of the photoconductor drum 104. The lubricant supply unit 220 includes a brush member 224 used as a rotating member and is provided with a solid lubricant 240.

The brush member 224 is rotated in a direction of arrow b shown in FIG. 2 in contact with the solid lubricant 240 and the photoconductor drum 104. Also, the brush member 224 includes a rotation shaft 226 rotatably provided on the cleaning device body 202, many brash bristles 228 being radially provided on the surface of the rotating shaft 226. The rotation shaft 226 has a diameter of, for example, about 6 mm and is made of a conductive material, for example, a metal or the like, and grounded.

For the brush bristles 228, conductive fibers, for example, acrylic fibers of a fineness of 10 denier, are used. The "denier" is a unit used for showing a fineness of a yarn or the like, which is difficult to measure, by mass per a predetermined length in an alternative manner. Specifically, "1 denier" represents the mass in grams of a yarn of 9000 meters. In addition, the brush bristles 228 are planted into the rotation shaft 226 at a density of, for example, about 20,000 to 60,000/(inch)$^2$. When the brush bristles are planted into the rotation shaft 226, the outer diameter of the brush member 224 is about 19 mm.

The brush member 224 configured as described above is attached so that the brush bristles 228 contact the surface of the photoconductor drum 104 and bite into the photoconductor drums 104. The biting amount of the brush bristles 228 for the photoconductor drum 104 is, for example, about 0.7 to 1.3 mm. In addition, a driving source including, for example, a motor (not shown) is connected to the brush member 224 through a drive transmission mechanism including, for example, plural gears (not shown) so that drive is transmitted from the driving source to rotate the brush member 224 in the direction of arrow b as described above, for example, with a predetermined peripheral speed difference from the photoconductor drum 104.

In addition, the cleaning device 200 includes a transport member 250. The transport member 250 is provided in the cleaning device body 202 so as to be disposed near the bottom thereof. The transport member 250 includes a helical blade portion 252 and transports the toner, paper dust, and the like, which are removed from the surface of the photoconductor drum 104 by the cleaning blade 204 and the brush member 224, to the outside of the cleaning device body 202.

The cleaning device 200 further includes a sealing member 256. The sealing member 256 seals a gap formed between the photoconductor drum 104 and the opening formed in the cleaning device body 202 in order to prevent the toner and the like, which are removed from the surface of the photoconductor drum 104 by the cleaning blade 204 and the brush member 224, from leaking out from the cleaning device body 202.

The cleaning device 200 further includes a contact member 258. The contact member 258 is, for example, a plate-shaped member and is provided in the cleaning device body 202 so as to be in contact with the brush bristles 228 disposed on the surface of the brush member 224 so that the toner, paper dust, an excess of the lubricant (excessive lubricant), and the like which adhere to the brush bristles 228 are removed by flicking.

As described above, the solid lubricant 240 is provided in contact with the brush bristles 228 inside the cleaning device body 202. In addition, the solid lubricant 240 contains a fatty acid metal salt such as zinc stearate or the like and a fluorocarbon resin, which are solidified to have, for example, a rectangular sectional shape. The solid lubricant 240 has pencil hardness HB and is in contact with the brush member 224 under a pressure of, for example, 1.18 N/m or less.

In addition, a holding member 260 is provided on the upper surface of the solid lubricant 240. In the holding member 260, portions projecting from both ends of the solid lubricant 240 are supported by the ends of support members 262 and 263 on one of the sides thereof. The support members 262 and 263 each include, for example, a plate spring formed by, for example, bending a metal into a Z-like shape, and the ends on the other side are attached to a crossbeam member 203 that constitutes a portion of the cleaning device body 202. In the above-described configuration, the solid lubricant 240 is supported elastically by the support members 262 and 263 in the vertical direction and supported in a substantially fixed state in the rotational direction of the brush member 224. The pressure of the solid lubricant 240 to the brush member 224 is determined by the weights of the solid lubricant 240 and the holding member 260.

In the cleaning device 200 configured as described above, when the brush member 224 is rotated in the direction of arrow b, at the position P2, foreign materials such as the toner, paper dust, and the like which adhere to the surface of the photoconductor drum 104 are disturbed by the brush member 224 and partially scraped off by the brush member 224 from the surface of the photoconductor drum 104. The foreign materials not scraped by the brush member 224 are scraped off at the position P1 by the cleaning blade 204 from the surface of the photoconductor drum 104. The toner and the like scraped off by the brush member 224 from the photoconductor drum 104 and the toner and the like scraped by the cleaning blade 240 from the photoconductor drum 104 fall and reach the transport member 250 and are transported to the outside of the cleaning device body 202 by the transport member 250.

In addition, the brush member 224 is rotated in contact with the lower end of the solid lubricant 240 so as to scrape in small amounts the lubricant from the lower end of the solid lubricant 240 and hold the lubricant in a fluid powder state on the brush bristles 228. When a portion of holding the powdered lubricant in the brush bristles 228 reaches the position of the contact member 258 by rotation of the brush member 224, the brush bristles 228 contact the contact member 258, and the excessive lubricant of relatively large particle size is scraped off from the brush bristles 228. As a result, the brush bristles 228 hold only the lubricant of relatively small particle size. In this case, the scraping performance of the brush member 224 is improved by transmission of micro vibration to the solid lubricant 240 through the beam member 203. Then, when the portion where the brush bristles 228 hold the lubricant of relatively small particle size reaches the position P2 by rotation of the brush member 224, the lubricant held by the brush bristles 228 is applied onto the surface of the photoconductor drum 104.

When the lubricant is applied onto the surface of the photoconductor drum 104, friction between the cleaning blade 204 and the photoconductor drum 104 is decreased by the lubricant. Therefore, the photoconductor drum 104 little wears, and the cleaning blade 204 little wears.

In the cleaning device 200, a lubricant containing zinc stearate as the fatty acid metal salt and polytetrafluoroethylene (hereinafter referred to as "PTFE") as the fluorocarbon resin is used as the solid lubricant 240. The solid lubricant 240 may contain another fatty acid metal salt in place of zinc stearate. The "fatty acid metal salt" represents a compound in which H of a fatty acid is substituted by metal ion. The "fatty acid" represents a monovalent long-chain hydrocarbon carboxylic acid. Examples of a metal that constitutes the fatty acid metal salt include zinc, lithium, sodium, magnesium, lead, nickel, and the like. Examples of a fatty acid that constitutes the fatty acid metal salt include stearic acid, lauric acid, palmitic acid, and the like.

More specifically, instead of a lubricant containing only zinc stearate, a lubricant containing at least one fatty acid metal salt selected from zinc stearate, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, and the like may be used as the solid lubricant 240.

In addition, instead of the lubricant containing PTFE as a fully-fluorinated resin, a lubricant containing a partially-fluorinated resin such as polychlorotrifluoroethylene (PCTFE), polyvinylidene fluoride (PVDE), or polyvinyl fluoride (PVF), or a fluorinated resin copolymer such as perfluoroalkoxy fluorocarbon resin (PFA), tetrafluoroethylene/hexafluoropropylene copolymer (FEP), ethylene/tetrafluoroethylene copolymer (ETFE), ethylene/chlorotrifluoroethylene copolymer (ECTFE), or the like may be used as the solid lubricant 240.

The solid lubricant 240 is produced by mixing a melted fatty acid salt lubricant with a powdered fluorocarbon resin, dispersing the powdered fluorocarbon resin in the melted fatty acid salt lubricant, and then cooling the melted fatty acid salt by, for example, pouring into a rectangular mold and cooling.

FIG. 4 illustrates operations of the cleaning blade 204.

Figure 4A:
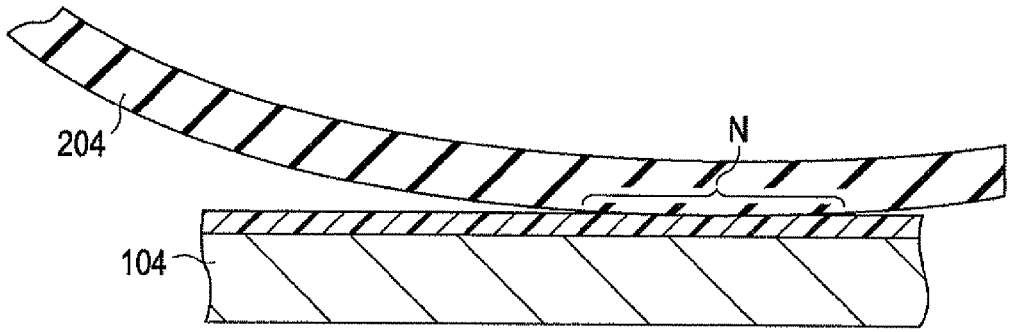
Figure 4B:
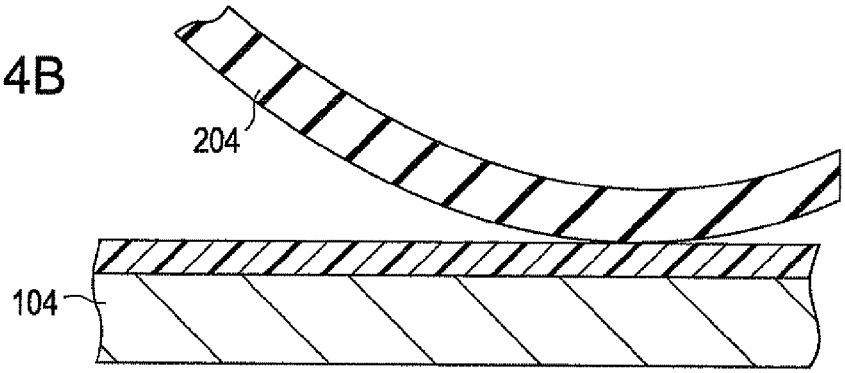
Figure 4C:
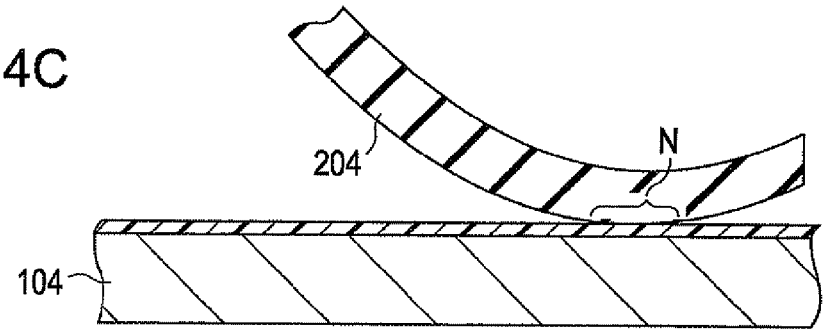
Figure 4D:
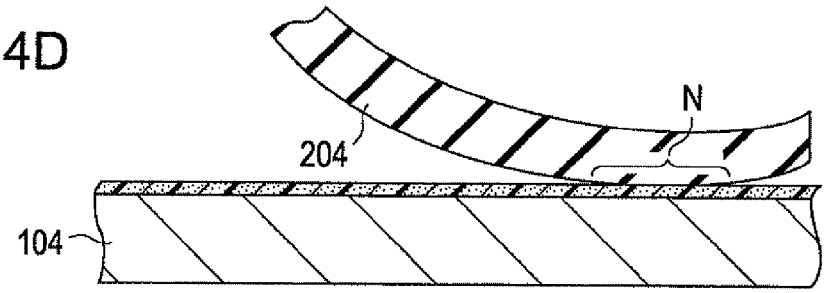

When a solid lubricant containing zinc stearate and PTFE at a proper ratio of zinc stearate to PTFE is used as the solid lubricant 240, as shown in FIG. 4D, a nip N formed between the photoconductor drum 104 and the cleaning blade 204 is stabilized because the coefficient of dynamic friction on the surface of the photoconductor drum 104 is decreased by applying the lubricant. Therefore, the toner and the like do not leak through the nip N. In addition, vibration of the cleaning blade 204 is suppressed, and thus sound due to vibration of the cleaning blade 204 is suppressed. Further, since the solid lubricant 240 contains PTFE, the amount of the lubricant applied to the surface of the photoconductor drum in order to decrease the coefficient of dynamic friction of the photoconductor drum 104 may be smaller than that in the use of a lubricant not containing PTFE. Therefore, there little occurs the problem that the lubricant adheres to other members and contaminate the other members.

In contrast, when a lubricant containing zinc stearate but not containing PTFE is used as the solid lubricant 240, as shown in FIG. 4A, the nip N is widened by increasing the amount of the lubricant applied for decreasing the coefficient of dynamic friction of the photoconductor drum 104. Consequently, vibration easily occurs in the cleaning blade 204, and thus sound is easily produced due to the vibration of the cleaning blade 204.

In addition, when a lubricant containing zinc stearate but not containing PTFE is used as the solid lubricant 240, as shown in FIG. 4B, with the lubricant applied to the photoconductor drum 104 in an amount larger than that in the case shown in FIG. 4A, the lubricant applied to the photoconductor drum 104 may adhere to other members and thus contaminate the other members.

Further, when a lubricant containing zinc stearate but not containing PTFE is used as the solid lubricant 240, as shown in FIG. 4C, with a small amount of the lubricant applied to the photoconductor drum 104, the nip N is not stabilized, and thus the toner and the like may leak through the nip N. In addition, the coefficient of dynamic friction of the photoconductor drum 104 is not sufficiently decreased, thereby easily producing vibration of the cleaning blade 204 and sound due to the vibration of the cleaning blade 204.

FIG. 5 shows a relation between the ratio of PTFE to zinc stearate in the solid lubricant 240 and sound produced by forming an image with the image forming apparatus 10 when the ratio of PTFE to zinc stearate in the solid lubricant 240 is changed. The criteria for evaluation are as follows:

CIRCLE: No fluttering sound of the cleaning blade 204 is heard even when an apparatus cover is removed.

TRIANGLE: A fluttering sound of the cleaning blade 204 is heard when an apparatus cover is removed.

CROSS: A fluttering sound of the cleaning blade 204 is slightly heard.

DOUBLE CROSS: A large fluttering sound of the cleaning blade 204 is heard.

TRIPLE CROSS: The solid lubricant is cracked or broken.

The "fluttering sound of the cleaning blade 204" represents a sound produced due to vibration of the cleaning blade 204.

The results shown in FIG. 5 indicate that in order to prevent a fluttering sound of the cleaning blade 204 from being heard even when the apparatus cover is removed and to suppress vibration, the ratio of PTFE to zinc stearate in the solid lubricant 240 is desirably about 3% or more and 30% or less. In this case, when the ratio of PTFE to zinc stearate is about 0%, 1%, or 2%, a large fluttering sound of the cleaning blade 204 occurs. This is because a small amount of PTFE adheres to the surface of the photoconductor drum 104, and thus the coefficient of dynamic friction of the photoconductor drum 104 is not sufficiently decreased.

On the other hand, when the ratio of PTFE to zinc stearate is about 30%, a large fluttering sound of the cleaning blade 204 occurs. This is because the solid lubricant 240 is hardened by increasing the ratio of PTFE, and thus the solid lubricant 240 is little scraped by the brush member 224, thereby decreasing the amount of the lubricant supplied to the surface of the photoconductor drum 104. In addition, when the ratio of PTFE to zinc stearate is about 35%, the solid lubricant 240 is hardened and embrittled, thereby causing cracking or breakage of the solid lubricant 240.

Figure 6:
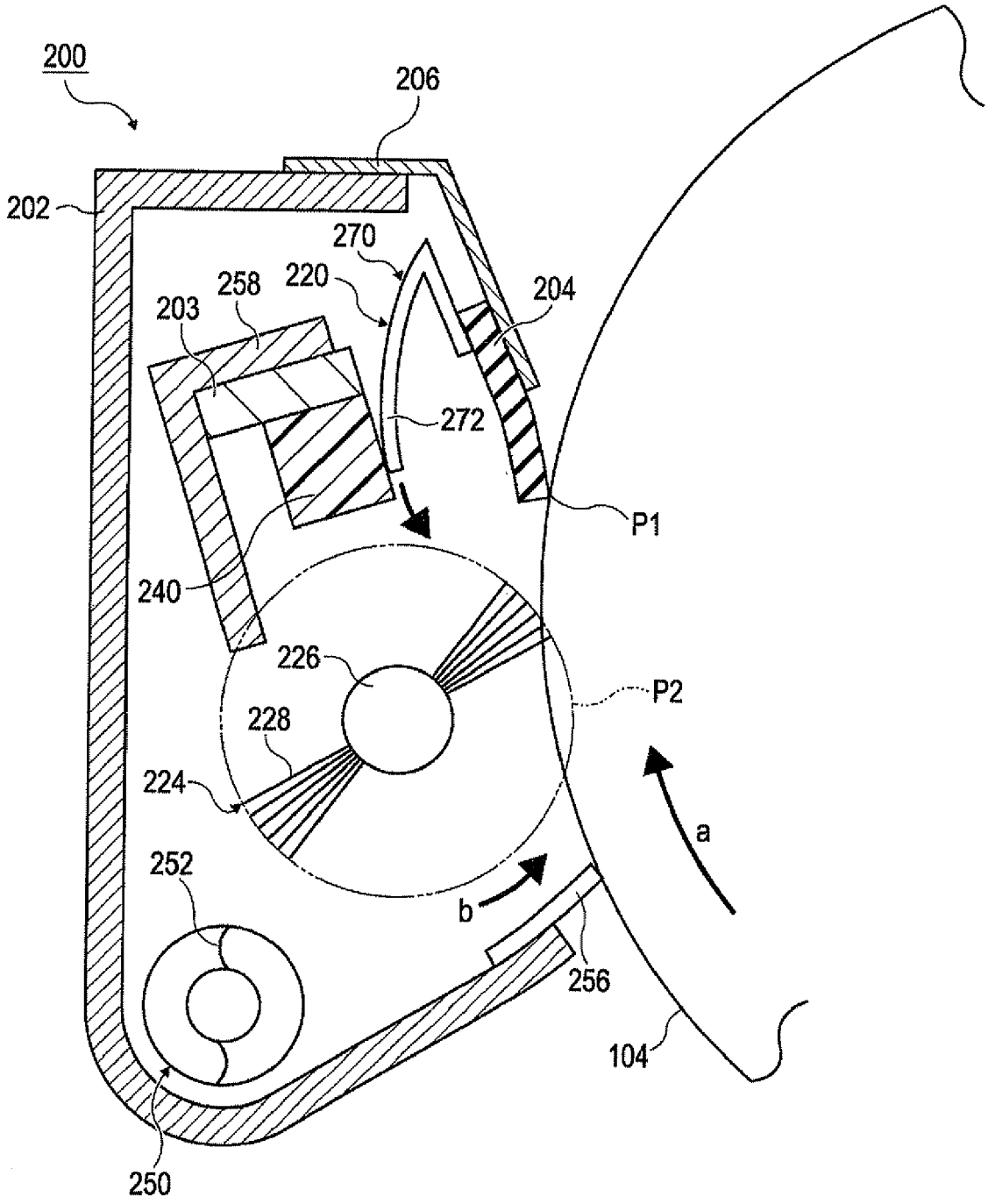
FIG. 6 is a sectional view showing a cleaning device according to a second exemplary embodiment of the present invention as viewed from the front side.

FIG. 6 shows a cleaning device 200 according to a second exemplary embodiment of the present invention.

The cleaning device 200 according to the first exemplary embodiment includes the lubricant supply device 220 that supplies the lubricant to the photoconductor drum 104, and the lubricant supply device 220 includes the brush member 224 (refer to FIG. 2) so that the solid lubricant 240 is powdered by scraping with the brush member 224, transported to the photoconductor drum 104 by the brush member 224, and supplied to the photoconductor drum 104. On the other hand, in the cleaning device 200 according to the second exemplary embodiment of the present invention, as shown in FIG. 6, a lubricant supply device 220 includes a vibrator 270 used for powdering the solid lubricant 240.

The vibrator 270 includes a vibration member 272 and vibrates in contact with the solid lubricant 240 due to transmission of vibration from the cleaning blade 204. As the vibration member 272, for example, a plate-shaped member having flexibility, such as a PET (polyethylene terephthalate) plate or the like, may be used. The vibration member 272 is bent at a position, and one of the ends is attached to the cleaning blade 204, the other end being in contact with the solid lubricant 240 while being pressed due to flexibility.

When the cleaning blade 204 is vibrated by rotation of the photoconductor drum 104, vibration is transmitted to the vibration member 272 from the cleaning blade 204, and the vibration member 272 vibrates in contact with the solid lubricant 240. Thus, a portion of the solid lubricant 240 that is in contact with the vibration member 272 is scraped off to form a powder. The powdered lubricant falls and is supplied to the brush member 224, and then supplied to the photoconductor drum 104 at position P2 by rotation of the brush member 224 in a direction of arrow b. In FIG. 6, the same portions as in the first exemplary embodiment are denoted by the same reference numerals as in FIG. 2 and are not described. Like in the first exemplary embodiment, the brush member 224 may be in contact with the solid lubricant so that the scraping performance of a brush is improved by vibration transmitted from the vibration member 272.

In the above-described first and second exemplary embodiments, description is made of the case in which the photoconductor drum 104 is used as the member to be cleaned and used as the image carrier. However, the present invention may be applied to an exemplary embodiment in which for example, an intermediate transfer member to which an image formed with an image forming agent is transferred from a photoconductor drum or the like and from which the transferred image is transferred to a recording medium such as paper or the like may be used as a member to be cleaned and used as an image carrier.

As described above, the present invention may be applied to a cleaning device that cleans a member to be cleaned or an image carrier, an image forming apparatus, for example, a copying machine, a facsimile, a printer, or the like, and a solid lubricant used for the device and apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a scraping member that scrapes foreign materials from a member to be cleaned while being in contact with the member to be cleaned; and a lubricant supply unit that supplies a lubricant upstream of a contact position between the member to be cleaned and the scraping member in a moving direction of the member to be cleaned, wherein the lubricant supply unit supplies a solid lubricant containing a fatty acid metal salt and a fluorocarbon resin, wherein the lubricant supply unit includes a rotary member that rotates in contact with the solid lubricant and the member to be cleaned, and wherein the lubricant supply unit includes a vibrator that vibrates the solid lubricant by transmission of vibration due to contact between the rotary member and a contact member downstream of a position where the rotary member contacts the solid lubricant or contact between the member to be cleaned and the scraping member.

2. The cleaning device according to claim 1, wherein the contact member shakes off an excess of the lubricant held by the rotary member while being in contact with the surface of the rotary member.

3. The cleaning device according to claim 1, wherein the lubricant containing the fluorocarbon resin at a ratio of 3% or more and 30% or less to the fatty acid metal salt is supplied to the member to be cleaned.

4. The cleaning device according to claim 1, wherein the vibrator contacts the scraping member.

5. The cleaning device according to claim 1, further comprising a supporting member that supports both the lubricant supply unit and the contact member.

6. The cleaning device according to claim 1, wherein the solid lubricant is a powder.

7. A cleaning device comprising:

a scraping member that scrapes at least an image forming agent from an image carrier while being in contact with the image carrier; and a lubricant supply unit that supplies a lubricant upstream of a contact position between the image carrier and the scraping member in a moving direction of the image carrier, wherein the lubricant supply unit supplies a solid lubricant containing a fatty acid metal salt and a fluorocarbon resin, wherein the lubricant supply unit includes a rotary member that rotates in contact with the solid lubricant and the member to be cleaned, and wherein the lubricant supply unit includes a vibrator that vibrates the solid lubricant by transmission of vibration due to contact between the rotary member and a contact member downstream of a position where the rotary member contacts the solid lubricant, or contact between the member to be cleaned and the scraping member.

8. The cleaning device according to claim 7, wherein the vibrator contacts the scraping member.

9. The cleaning device according to claim 7, further comprising a supporting member that supports both the lubricant supply unit and the contact member.

10. The cleaning device according to claim 7, wherein the solid lubricant is a powder.

11. An image forming apparatus comprising:

an image carrier;

a transfer device that transfers, to a transfer medium, an image formed of an image forming agent and held by the image carrier; and a cleaning device that cleans off at least the image forming agent remaining on the image carrier after the transfer by the transfer device, wherein the cleaning device includes a scraping member that scrapes the image forming agent from the image carrier while being in contact with the image carrier, and a lubricant supply unit that supplies a lubricant upstream of a contact position between the image carrier and the scraping member in a moving direction of the image carrier; and the lubricant supply unit supplies a solid lubricant containing a fatty acid metal salt and a fluorocarbon resin, wherein the lubricant supply unit includes a rotary member that rotates in contact with the solid lubricant and the member to be cleaned, and wherein the lubricant supply unit includes a vibrator that vibrates the solid lubricant by transmission of vibration due to contact between the rotary member and a contact member downstream of a position where the rotary member contacts the solid lubricant, or contact between the member to be cleaned and the scraping member.

12. The image forming apparatus according to claim 11, wherein the vibrator contacts the scraping member.

13. The image forming apparatus according to claim 11, further comprising a supporting member that supports both the lubricant supply unit and the contact member.

14. The image forming apparatus according to claim 11, wherein the solid lubricant is a powder.

15. A solid lubricant used in a cleaning device including a scraping member that scrapes foreign materials from a member to be cleaned while being in contact with the member to be cleaned, and a lubricant supply unit that supplies a lubricant upstream of a contact position between the member to be cleaned and the scraping member in a moving direction of the member to be cleaned, the lubricant comprising a solid containing a fatty acid metal salt and a fluorocarbon resin, the lubricant containing the fluorocarbon resin at a ratio of about 3% or more and about 30% or less to the fatty acid metal salt.

16. The solid lubricant according to claim 15, wherein the solid lubricant is a powder.

* * * * *